US010077641B2

(12) United States Patent
Rogman et al.

(10) Patent No.: US 10,077,641 B2
(45) Date of Patent: Sep. 18, 2018

(54) PERFORATING GUN WITH INTEGRATED INITIATOR

(71) Applicant: Schlumberger Technology Corporation, Sugar Land, TX (US)

(72) Inventors: Raphael Rogman, Houston, TX (US); Allan Goldberg, Alvin, TX (US); Vinod Chakka, Pune (IN); Pedro Hernandez, Sugar Land, TX (US); Roman Munoz, Pearland, TX (US); Richard Lee Warns, Sugar Land, TX (US); Hao Liu, Missouri City, TX (US); Marcos Calderon, Angleton, TX (US); Edward Harrigan, Richmond, TX (US); Kenneth Randall Goodman, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 410 days.

(21) Appl. No.: 14/649,577

(22) PCT Filed: Dec. 4, 2013

(86) PCT No.: PCT/US2013/073094

§ 371 (c)(1),
(2) Date: Jun. 4, 2015

(87) PCT Pub. No.: WO2014/089194

PCT Pub. Date: Jun. 12, 2014

(65) Prior Publication Data

US 2015/0330192 A1 Nov. 19, 2015

Related U.S. Application Data

(60) Provisional application No. 61/733,129, filed on Dec. 4, 2012.

(51) Int. Cl.
*E21B 43/116* (2006.01)
*E21B 43/1185* (2006.01)
(Continued)

(52) U.S. Cl.
CPC ..... *E21B 43/116* (2013.01); *E21B 43/117* (2013.01); *E21B 43/1185* (2013.01); *E21B 43/11855* (2013.01); *F42C 15/34* (2013.01)

(58) Field of Classification Search
CPC ..... E21B 43/116; E21B 43/11855; E21B 43/117; E21B 43/1185; F42C 15/34
See application file for complete search history.

(56) References Cited

U.S. PATENT DOCUMENTS 2,062,974 A 12/1936 Lane et al.
4,619,333 A 10/1986 George
(Continued)

FOREIGN PATENT DOCUMENTS

CN 2244095 Y 1/1997
CN 101575965 A 11/2009
(Continued)

OTHER PUBLICATIONS

Communication article 94-3 issued in the related EP application 13860417.8, dated Mar. 8, 2017 (6 pages).
(Continued)

*Primary Examiner* — Brad Harcourt
(74) *Attorney, Agent, or Firm* — Tim W. Curington

(57) ABSTRACT

A wellbore perforating device includes at least one perforating charge and an initiator. The initiator can include a ballistic train adapted to fire the at least one perforating charge. The ballistic train can include a detonator and a detonator cord. A ballistic interrupt shutter can be disposed between the detonator and the detonator cord. The ballistic interrupt shutter can prevent firing of the detonator cord.

19 Claims, 6 Drawing Sheets

(51) Int. Cl.

| | |
|---|---|
| ***E21B 43/117*** | (2006.01) |
| ***F42C 15/34*** | (2006.01) |

(56) References Cited

U.S. PATENT DOCUMENTS

| | | | | |
|---|---|---|---|---|
| 4,909,320 | A | 3/1990 | Hebert et al. | |
| 5,007,486 | A | 4/1991 | Ricles | |
| 6,412,388 | B1 * | 7/2002 | Frazier | E21B 43/117 102/312 |
| 6,752,083 | B1 | 6/2004 | Lerche et al. | |
| 7,347,278 | B2 | 3/2008 | Lerche et al. | |
| 8,113,119 | B2 | 2/2012 | Crawford | |
| 8,256,337 | B2 | 9/2012 | Hill et al. | |
| 2004/0216866 | A1 | 11/2004 | Barlow et al. | |
| 2009/0151589 | A1 | 6/2009 | Henderson et al. | |
| 2009/0159285 | A1 | 6/2009 | Goodman | |
| 2010/0005992 | A1 | 1/2010 | Crawford | |
| 2011/0024116 | A1 | 2/2011 | McCann et al. | |
| 2012/0018157 | A1 | 1/2012 | Gill et al. | |
| 2012/0138286 | A1 | 6/2012 | Mason et al. | |
| 2012/0152542 | A1 | 6/2012 | Le | |
| 2012/0199352 | A1 | 8/2012 | Lanclos et al. | |
| 2012/0247771 | A1 | 10/2012 | Black et al. | |
| 2013/0043074 | A1 | 2/2013 | Tassaroli | |
| 2013/0048376 | A1 | 2/2013 | Rodgers et al. | |
| 2013/0153205 | A1 | 6/2013 | Borgfeld et al. | |

FOREIGN PATENT DOCUMENTS

| | | | |
|---|---|---|---|
| EP | 0175439 | A2 | 3/1986 |
| EP | 0601880 | A2 | 6/1994 |
| EP | 0919694 | A2 | 6/1999 |
| EP | 1930541 | A2 | 6/2008 |
| RU | 121054 | | 10/2012 |
| WO | 2013180765 | A1 | 12/2013 |
| WO | WO2014089194 | A1 | 6/2014 |
| WO | WO2014179669 | A1 | 11/2014 |

OTHER PUBLICATIONS

Office action issued in the related CN application 201380062953.4, dated Jun. 15, 2017 (20 pages).
RU Application No. 2015126872, Official Action, dated Aug. 10, 2016, 8 pgs.
Office Action issued in related EP application 13860417.8 dated Mar. 9, 2016, 6 pages.
European Search Report issued in related EP application 13860417.8 dated Feb. 22, 2016, 5 pages.
International Search Report and Written Opinion issued in the related PCT application PCT/US2014/036541, dated Sep. 12, 2014 (13 pages).
International Preliminary Report on Patentability issued in the related PCT application PCT/US2014/036541, dated Nov. 3, 2015 (09 pages).
International Search Report and Written Opinion issued in the related PCT application PCT/US2013/073094, dated Mar. 20, 2014 (9 pages).
International Preliminary Report on Patentability issued in the related PCT application PCT/US2013/073094, dated Jun. 9, 2015 (5 pages).
Office action issued in the related CN application 201380062953.4, dated Sep. 1, 2016 (22 pages).
Decision of Grant issued in the related RU application 2015126872, dated Dec. 1, 2016 (12 pages).
Communication article 94-3 issued in the related EP application 13860417.8, dated Jan. 19, 2018 (5 pages).
Office action issued in the related CN application 201380062953.4, dated Feb. 27, 2018 (11 pages).
Office Action issued in the related U.S. Appl. No. 14/888,882 dated May 25, 2018 (36 pages).

* cited by examiner

PERFORATING GUN WITH INTEGRATED INITIATOR

BACKGROUND

Wellbore perforation services are used to produce hydrocarbons from a subterranean formation. Such perforating operations oftentimes rely on perforating guns to perforate the formation. Perforating guns are lowered into a wellbore from a wireline truck located at the surface while maintaining a wired connection between the surface and the perforating gun located downhole. Perforating guns contain explosive charges and an initiator. The initiator is designed to fire the explosive charges after the initiator detects an appropriate command from the surface.

The explosive charges can be detonated unintentionally by radio frequencies, for example, by those emitted from cell phones. Such radio frequencies interfere with or bypass the initiator causing the premature or unintentional detonation of the explosive charges. Also, wiring of the initiator to the perforating gun is oftentimes performed at the surface near the well site, instead of at a dedicated manufacturing facility. Performing wiring at the surface of the well site increases the likelihood of human error during the wiring process, while also being a time-consuming operation that requires specific training. Finally, the initiator can be detonated unintentionally by stray currents present on the wireline or by exposure to high voltage that can occur due to ESD (Electro Static Discharge) or lightening.

There is a need, therefore, for new systems and methods that prevent premature detonation of a perforating gun, while reducing wiring operations performed at the surface.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A wellbore perforating device is disclosed. The wellbore perforating device can include at least one perforating charge and an initiator. The initiator can include a ballistic train adapted to fire the at least one perforating charge. The ballistic train can include a detonator and a detonator cord. A ballistic interrupt shutter can be disposed between the detonator and the detonator cord. The ballistic interrupt shutter can prevent firing of the detonator cord.

A perforating gun is also disclosed. The perforating gun can include a loading tube. The loading tube can have an initiator disposed therein. The initiator can include a detonator and a detonator cord. At least one perforating charge can be disposed within the loading tube. A ballistic interrupt shutter can be disposed between the detonator and the detonator cord. The ballistic interrupt shutter can include a metallic layer disposed adjacent a layer of thermoplastic material.

A method of using a wellbore perforating device is also disclosed. The method can include inserting an initiator into a loading tube of the wellbore perforating device. The initiator can include a detonator and a detonator cord. A ballistic interrupt shutter can be disposed between the detonator and the detonator cord. The ballistic interrupt shutter can include a metallic layer disposed adjacent a layer of thermoplastic material. The method can also include lowering the wellbore perforating device into a wellbore and executing a first command releasing the ballistic interrupt shutter from between the detonator and the detonator cord. The method can also include executing a second command firing the wellbore perforating device.

BRIEF DESCRIPTION OF THE DRAWINGS

So that the recited features can be understood in detail, a more particular description, briefly summarized above, can be had by reference to one or more embodiments, some of which are illustrated in the appended drawings. It is to be noted, however, that the appended drawings are illustrative embodiments, and are, therefore, not to be considered limiting of its scope.

DETAILED DESCRIPTION

Figure 1:
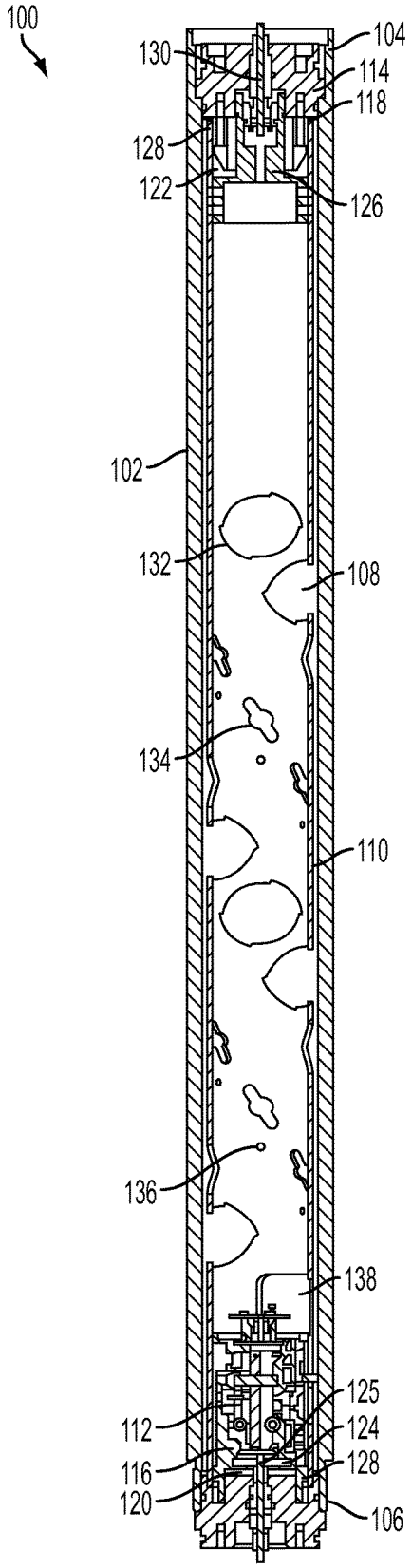
FIG. 1 depicts a cross sectional view of an illustrative wellbore perforating device, according to one or more embodiments disclosed.

FIG. 1 depicts a cross sectional view of an illustrative wellbore perforating device 100, according to one or more embodiments. The wellbore perforating device 100 can have a body or carrier 102 having a first or "upper" end 104 and a second or "lower" end 106. The use of the terms "upper" and "lower" do not limit the orientation of the perforating device, which can be placed at any angle with respect to a vertical plane within a wellbore. The carrier 102 can have an inner bore 108 formed therethrough for containing a loading tube 110. The carrier 102 and the loading tube 110 can each be tubular members, and the loading tube 110 can be disposed longitudinally within the carrier 102. The loading tube 110 can have a first or "upper" end 122 and a second or "lower" end 124. An upper connector assembly 126 can be disposed on the loading tube 110, for example, at or near the first end 122. A lower connector assembly 125 can be disposed on the loading tube 110, for example, at or near the second end 124. The upper connector assembly 126 and lower connector assembly 125 can include one or more projections (not shown) or features, such as tabs, rods, or cavities that can engage corresponding holes, recesses (not shown), or protrusions (not shown) disposed in the carrier 102. The wellbore perforating device 100 can contain an initiator assembly 112. The initiator assembly 112 can include a ballistic interrupt shutter 406 (see FIG. 4). The ballistic interrupt shutter 406 can be adapted to prevent detonation until a command is sent to release the shutter. The initiator assembly can be replaceable in the field by other initiator assemblies such as R.F. Safe (Radio Frequency Safe) or other initiator assemblies.

As used herein, the terms "up" and "down;" "upper" and "lower;" "upwardly" and "downwardly;" "upstream" and "downstream;" and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate. It is also understood that the perforating device can be deployed in a reversed configuration, with the spatial orientations and relationships being inverted, i.e. with the features identified "up" oriented down and the features labeled "down" oriented up.

Still referring to FIG. 1, the wellbore perforating device 100 can include one or more bulkheads (two are shown 114, 116). The bulkheads 114, 116 can be connected to ends of the loading tube 110. For example, a first bulkhead 114 can be connected to the first end 122 of the loading tube 110, and a second bulkhead 116 can be connected to the second end 124 of the loading tube 110. The first bulkhead 114 can be disposed on or near the first end 104 of the carrier 102. The second bulkhead 116 can also be disposed on or near the second end 106 of the carrier 102. The first and second bulkheads 114, 116 can isolate the loading tube 110 from fluids external to the loading tube 110 (e.g., wellbore fluids).

The wellbore perforating device 100 can include one or more shock absorbers (two are shown 118, 120). The shock absorbers 118, 120 can isolate the initiator from perforating shock and/or compensate for any axial or radial movement of and end of the loading tube 110 to ensure proper connection to a second loading tube 110 or other device. The shock absorbers 118, 120 can be connected to the first end 122 and/or the second end 124 of the loading tube 110. The shock absorbers 118, 120 can be or include a gasket or flange and can be disposed anywhere between the first and second bulkheads 114, 116 and the loading tube 110. For example, the first shock absorber 118 can be disposed between the first bulkhead 114 and the first end 122 of the loading tube 110, and the second shock absorber 120 can be disposed between the second bulkhead 116 and the second end 124 of the loading tube 110. The first shock absorber 118 can be in direct contact with the first bulkhead 114 and the loading tube 110, and the second shock absorber 120 can be in direct contact with the second bulkhead 116 and the loading tube 110.

The first and second bulkheads 114, 116 can include one or more centralizers 128 for centralizing and aligning the loading tube 110 with the carrier 102 and/or and adjacent loading tube 110. The one or more centralizers 128 can include one or more projections (not shown) and one or more corresponding slots or grooves (not shown). The one or more projections can be disposed on the bulkheads 114, 116, and the corresponding slots or grooves can be disposed on the loading tube 110. In another embodiment, the one or more projections can be disposed on the loading tube 110 and the corresponding slots or grooves can be disposed on the bulkheads 114, 116. The centralizing feature can include a ring or standoff features supported by the inner wall of the carrier. The first and second bulkheads 114, 116 can also include one or more coaxial conduits adapted to allow a coaxial cable, such as a power cable or any other wiring, to pass through the first and second bulkheads 114, 116 while maintaining fluid isolation of the loading tube 110 and space between the carrier 102 and the loading tube 110. For example, the first and second bulkheads 114, 116 can include a seal 130 that fits between the bulkhead 114 or 116 and a coaxial cable passing therethrough. The seal 130 can be disposed in annulus (not shown) formed between the bulkhead 114 or 116 and the cable to maintain fluid isolation of the loading tube 110.

The loading tube 110 can include one or more charge jacket holders 132 (six are at least partially shown in FIG. 1). The charge jacket holders 132 can contain perforating charges (not shown) that can be outwardly directed in a radial and/or tangential direction, for example, to perforate a casing string and/or form corresponding perforation tunnels into the surrounding formation. The charge jacket holders 132 can be arranged in a phasing pattern (a helical or spiral phasing pattern, missing arc helical phasing pattern, a planar phasing pattern, etc.), depending on the perforating application. The loading tube 110 can include one or more detonating cord slots 134. The detonator cord slots 134 can be adapted to receive a detonating cord for connecting to primer ends of the perforating charges disposed in the charge jacket holders 132. The detonator cord slots 134 can be arranged in a manner similar to that of the charge jacket holders 132. For example, the detonator cord slots 134 can be arranged in a phasing pattern, such as a helical or spiral phasing pattern, a missing arc helical phasing pattern, a planar phasing pattern. The loading tube 110 can also include one or more electrical wire holder holes 136 or other fastening features. The other fastening features can include fasteners or adhesives formed out of, placed on, or threaded through, the loading tube 110. The electrical wire holder holes or features 136 can be arranged in a manner similar to that of the charge jacket holders 132 and the detonator cord slots 134. For example, the electrical wire holder holes or features 136 can be arranged in a phasing pattern, such as a helical or spiral phasing pattern, a missing arc helical phasing pattern, a planar phasing pattern. The electrical wire holder holes or features 136 can retain wire holders and give wires a dedicated path through the loading tube 110. Such an arrangement can protect wires from being pinched by the charges and can prevent shock damage to wires by providing strain relief.

The loading tube 110 can include a cutaway section 138. The cutaway section 138 can be located proximate the initiator assembly 112 to provide access to the initiator assembly 112. The cutaway section 138 can permit visual inspection or verification of a state of the ballistic interrupt shutter 406 (see FIG. 4). The cutaway section 138 can also permit the removal and/or installation of the initiator assembly 112 or components thereof. For example, the cutaway section 138 can also permit the removal of the initiator assembly 112 and the installation of a different initiator, such as an RF safe initiator.

The component parts of the wellbore perforating device 100 can be formed from any material. For example, one or more component parts of the wellbore perforating device 100 can be formed from metals, such as carbon steel, stainless steel, nickel, nickel alloys, iron, aluminum, tungsten, ceramics, plastic, composite materials, glass, or the like. One or more component parts of the wellbore perforating device 100 can also be formed from one or more thermoplastic materials, such as polymers, elastomers, rubbers, and the like.

The thermoplastic material can include at least one polymer selected from butylene polymer, ethylene polymer, high density polyethylene (HDPE) polymer, medium density polyethylene (MDPE) polymer, low density polyethylene (LDPE) polymer, propylene (PP) polymer, isotactic polypropylene (iPP) polymer, high crystallinity polypropylene (HCPP) polymer, ethylene-propylene (EP) copolymers, ethylene-propylene-butylene (EPB) terpolymers, propylene-butylene (PB) copolymer, an ethylene elastomer, a ethylene-based plastomer, a propylene elastomer, styrenic polymers, styrenic copolymers, PEEK, Ryton®, commercially available from the Chevron Phillips company, Noryl® commercially available from Saudi Basic Industries Corporation, Zenite® and Zytel®, commercially available from E. I. du Pont de Nemours and Company, Polyimide, nylon, high temperature nylon, polystyrene, and combinations or blends thereof.

The shock absorbers 118, 120 and/or bulkheads 114, 116 can be formed from an elastomeric material. The elastomeric material can include natural rubber, conjugated diene monomers, aliphatic conjugated diene monomers, silicone rubber, and the like. The conjugated diene monomer can be selected from 1,3-butadiene, 2-methyl-1,3-butadiene, 2 chloro-1,3 butadiene, 2-methyl-1,3-butadiene, and 2 chloro-1,3-butadiene. The aliphatic conjugated diene monomer can include $C_4$ to $C_9$ dienes such as butadiene monomers. The shock absorbers can be formed from any one of or any combination of the plastics, elastomers, or metals described above.

Figure 2:
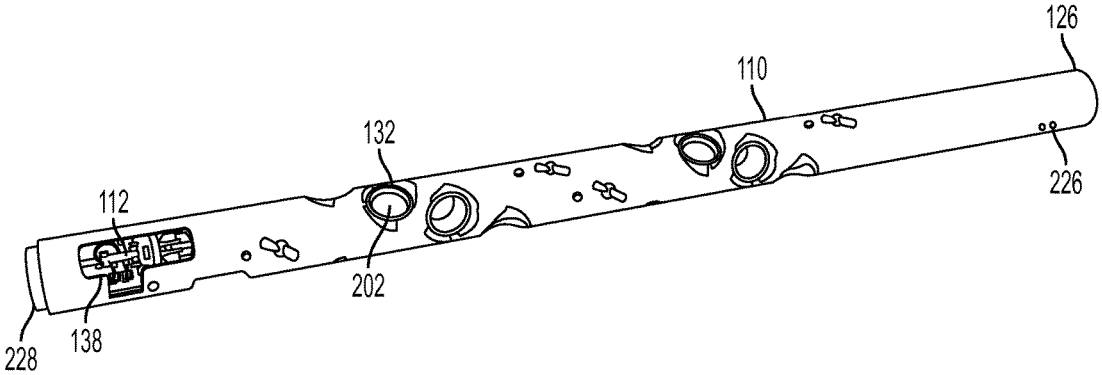
FIG. 2 depicts a side perspective view of an illustrative loading tube, according to one or more embodiments disclosed.

FIG. 2 depicts a side perspective view of the loading tube 110, according to one or more embodiments. The loading tube 110 can be formed from metals, such as carbon steel, stainless steel, nickel, nickel alloys, iron, aluminum, tungsten, cardboard, cellulose, styrofoam, expanded polystyrene, plastic, composite materials, ceramics, plaster, or the like. The loading tube 110 can also include a phosphate coating on the metal surfaces to provide corrosion resistance. The charge jacket holders 132 are shown containing perforating charges 202. The perforating charges 202 can be arranged in a phasing pattern (a helical or spiral phasing pattern, missing arc helical phasing pattern, a planar phasing pattern, etc.), depending on the perforating application.

The upper connector assembly 126 is shown with one or more projections or tabs 226 that can engage corresponding holes or recesses (not shown) disposed in the carrier 102 (see FIG. 1). The loading tube 110 can also include a lower connector assembly 228, as shown. The lower connector assembly 228 can be adapted to join or connect the loading tube 110 with the carrier 102 and/or with an adjacent loading tube 110. The loading tube 110 is shown containing the initiator assembly 112. The initiator assembly 112 can be visible through the cutaway section 138 of the loading tube 110. A user (not shown) can also access the initiator assembly 112 contained in the loading tube 110.

Figure 3:
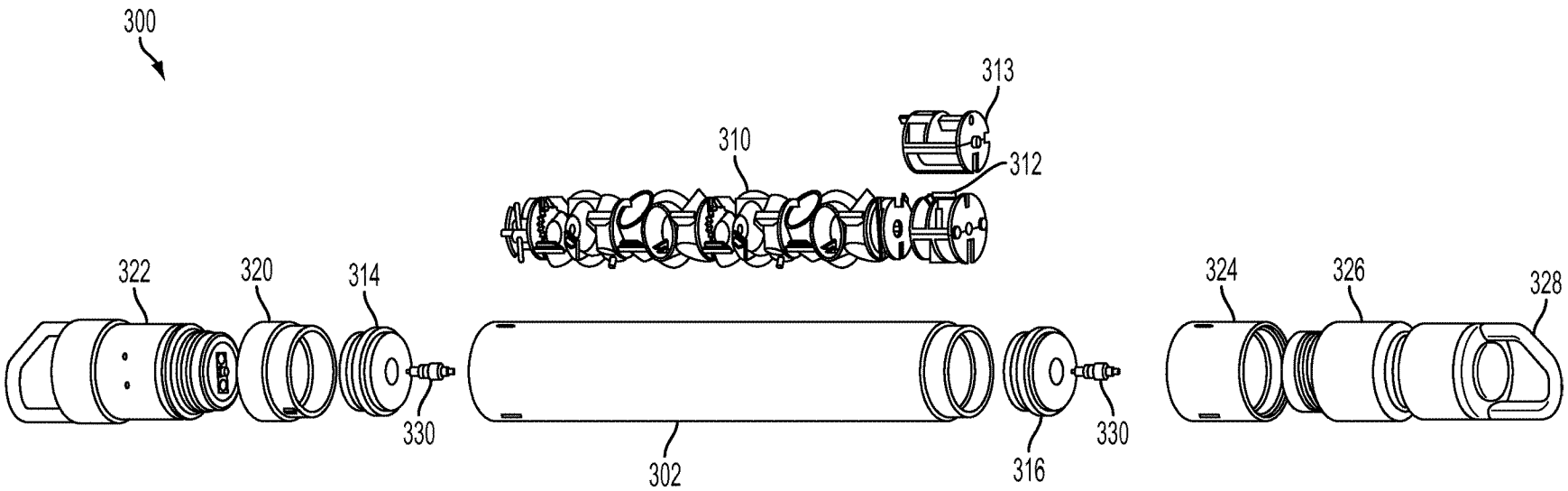
FIG. 3 depicts an exploded side perspective view of another illustrative wellbore perforating device, according to one or more embodiments disclosed.

FIG. 3 depicts an exploded side perspective view of another illustrative wellbore perforating device 300, according to one or more embodiments. The perforating device 300 can include a carrier 302, a loading tube 310, initiator assembly 312, a supplemental initiator assembly 313, bulkheads 314, 316, and seals 330 as disclosed in reference to FIGS. 1 and 2, above. At least the loading tube 310 and/or carrier 302 can be formed from any thermoplastic material as disclosed herein. For example, the loading tube 310 can be completely formed or molded from a thermoplastic material.

The wellbore perforating device 300 can also include an upper crossover 320 coupled to the upper bulkhead 314 and an upper head 322 coupled to the upper crossover 320. The wellbore perforating device 300 can also include a lower crossover 324 coupled to the lower bulk head 316, a plug and shoot 326 coupled to the lower crossover 324, and a handling cap 328 coupled to the plug and shoot 326. These components can prevent flooding of the wellbore perforating device 300 after perforating charges have detonated, flooding the carrier 302, thereby preventing exposure of the wellbore perforating device 300 to corrosive wellbore fluids. The upper crossover 320, the upper head 322, the lower crossover 324, the plug and shoot 326, and the handling cap 326 can connect the wellbore perforating device 300 to a conveyance system (not shown) that can lower the wellbore perforating device 300 in a well, such as wireline, slickline, coil tubing, or drill pipe. The upper crossover 320, the upper head 322, the lower crossover 324, the plug and shoot 326, and the handling cap 326 can also connect one or more wellbore perforating devices 300 in series or to other systems that can have sensing, actuating, and/or structural purposes.

Figure 4:
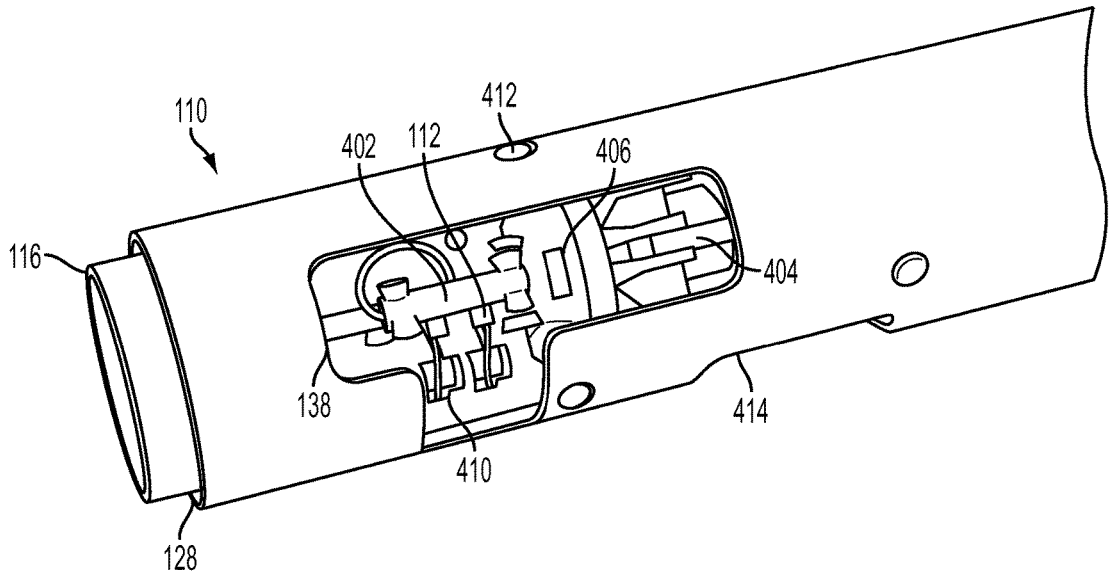
FIG. 4 depicts a side perspective view of an initiator of the loading tube of FIG. 2, according to one or more embodiments disclosed.

FIG. 4 depicts a side perspective view of the initiator assembly 112 of the loading tube 110 of FIG. 2, according to one or more embodiments disclosed. The initiator assembly 112 can include one or more detonators 402, one or more detonator cords 404, one or more ballistic interrupt shutters 406, one or more insulation-displacement connectors ("IDCs") 410, and one or more retaining tabs 412. The detonator 402 and the detonator cord 404 can form a ballistic train of the initiator 112. The detonator 402 can be or include a primary ignition source that initiates the ignition of the detonator cord 404. The detonator cord 404 can include a fuse and can be operably coupled to the detonator 402. The detonator 402 can initiate a detonation wave on the detonator cord 404, and the detonation wave can propagate on one or more subsequent detonating cord(s) 404 to the perforating charges 202 to cause the charges 202 to fire. Unintentional or premature firing or activation of the detonator cord 404 can be prevented by the ballistic interrupt shutter 406. For example, unintentional firing of the detonator cord 404 can be prevented until a particular command is sent to release the shutter 406.

The ballistic interrupt shutter 406 can include one or more layers of a metallic material disposed adjacent to one or more layers of a thermoplastic material. The ballistic interrupt shutter 406 can also include one or more layers of a metallic material sandwiched between two or more layers of a thermoplastic material. The metallic material can include any metallic material as disclosed herein, and the thermoplastic material can include any thermoplastic material as disclosed herein. The ballistic interrupt shutter 406 can be lodged between the detonator 402 and the detonator cord 404 prior to issuing of the particular command to release the shutter 406. The ballistic interrupt shutter 406 can prevent a signal or charge from transferring from the detonator 402 to the detonator cord 404 when the shutter 406 is lodged between the detonator 402 and the detonator cord 404. The ballistic interrupt shutter 406 can be dislodged or "opened" by being moved in a direction away from the detonator 402 and/or the detonator cord 404. The ballistic interrupt shutter 406 can be coupled to a spring (not shown). For example, the ballistic interrupt shutter 406 can be spring loaded. A particular signal can actuate the spring loaded shutter 406, dislodging the shutter 406 from between the detonator 402 and the detonator cord 404. The spring loaded shutter 406 can be actuated by burning of a fuse that causes the spring to release resulting in the dislodging of the shutter 406. Once the ballistic interrupt shutter 406 is dislodged, a signal or charge can be transferred from the detonator 402 to the detonator cord 404, resulting in detonation of the perforating charges 202. For example, the thermoplastic layer(s) of the ballistic interrupt shutter 406 can be removed, leaving behind the metallic layer(s). The metallic layer can permit a shock wave to travel from the detonator 402 to the detonator cord 404, causing ignition of the perforating charges 202. The metal layer of the shutter 406 as well as the thermoplastic layer can also be removed, allowing direct transmission of the shock wave from the detonator 402 to the detonating cord 402 through an air gap (not shown), causing detonation of the perforating charges 202.

The initiator assembly 112 can include a circuit board (not shown). The circuit board can communicate with a surface computer (not shown). The circuit board can also connect the detonator 402 to a power cable on command. The circuit board can also record diagnostic information while firing cable voltage during firing of the detonator 402. The circuit board can also communicate information regarding a status of the wellbore perforating device 100 to the surface such as location of the shutter 406 and a condition of a shutter 406 release mechanism, a status of the detonator 402, and other information such as temperature or acceleration of the wellbore perforating device 100. The circuit board can have a RF safe design. In an RF safe design, the initiator assembly 112 can be protected from inadvertent firing due to RF signals, electrostatic discharge (ESD), or stray currents. The circuit board can be connected to the detonator 402 via the insulation-displacement connectors ("IDCs") 410. The circuit board can also be connected to the power cable via the IDCs 410. The IDCs 410 for connecting the circuit board to the detonator 402 can be located proximate the cutaway section 138. An additional cutaway section 414 can be located proximate the IDCs 410 that are used to connect the circuit board to the power cable. The cutaway section 138 and additional cutaway section 414 can provide access to a user, allowing the user to connect or disconnect the IDCs 410 from the circuit board, the detonator 402, and/or the power cable. The circuit board can also be connected to the power cable and other perforating systems through multi-use connectors such as an RCA jack.

The initiator assembly 112 can be at least partially formed from a thermoplastic material as disclosed herein. One or more retaining tabs 412 can be formed from or disposed on the initiator assembly 112. The retaining tabs 412 can be sized and shaped to mate with corresponding holes or recesses in the loading tube 110 to ensure proper alignment of the initiator 112 in the loading tube 110. The retaining tabs 412 can permit quick removal and/or insertion of the initiator 112 to and/or from the loading tube 110. The retaining tabs 412 can also serve to isolate the circuit board from perforating shock, or to allow compliance to make up for gaps due to tolerances between the loading tube or carrier assembly.

Figure 5:
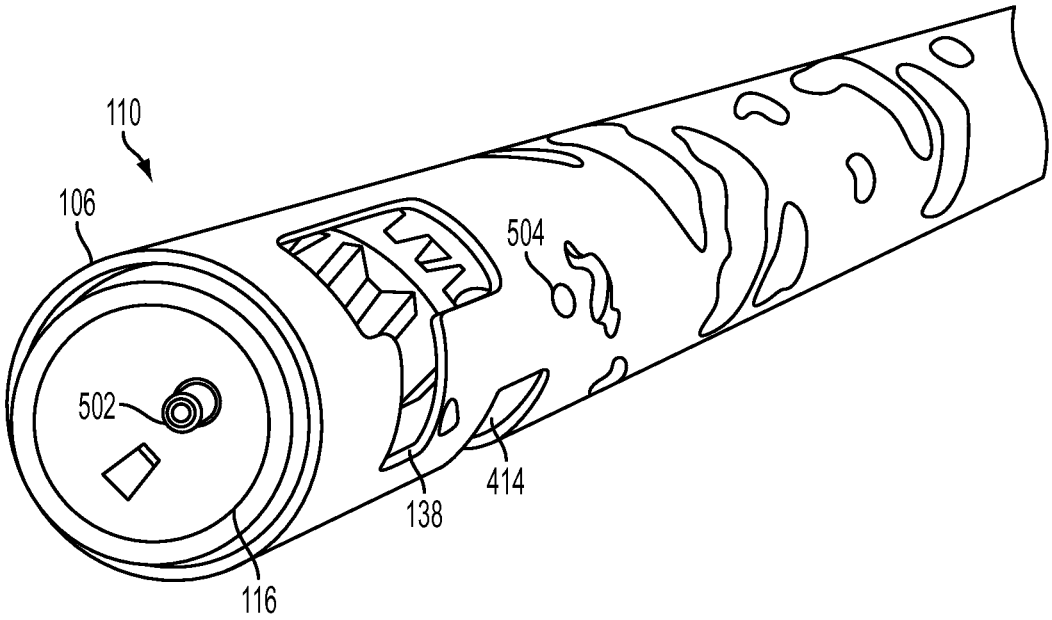
FIG. 5 depicts an end perspective view of the loading tube of FIG. 2, according to one or more embodiments disclosed.

FIG. 5 depicts an end perspective view of the loading tube 110 of FIG. 2, according to one or more embodiments disclosed. The lower bulkhead 116 is shown extending from the lower end 106 of the loading tube 110. The lower bulkhead 116 can be proximate the cutaway section 138 and the additional cutaway section 414, as shown. An end of a power cable 502 can protrude or extend through the lower bulkhead 116. The power cable 502 can run throughout the interior of the loading tube 110. For example, the power cable 502 can be held in place by wire holders 504 that are at least partially disposed in the electrical wire holder holes 136. As such, the wire holders 504 can be arranged in a phasing pattern, such as a helical or spiral phasing pattern, a missing arc helical phasing pattern, a planar phasing pattern, giving the power cable 502 a dedicated path through the loading tube 110. Such an arrangement of the power cable 502 can be pre-wired in the loading tube 110 prior to transportation to the well surface.

Figure 6:
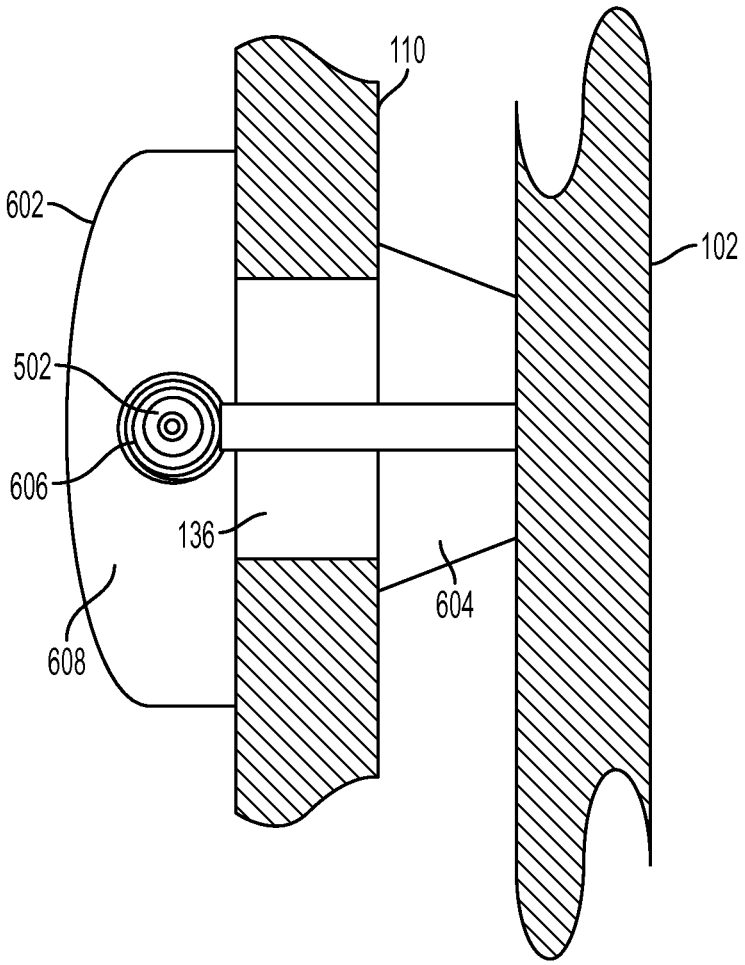
FIG. 6 depicts a cross sectional side view of an illustrative wire holder, according to one or more embodiments disclosed.

FIG. 6 depicts a cross sectional side view of an illustrative wire holder 602, according to one or more embodiments. The wire holder 602 can include a head portion 608 and a tab portion 604. The head portion 608 can have an inner bore 606 formed therethrough that is capable of retaining a wire or cable. For example, at least a portion of the power cable 502 can be retained by the inner bore 606. The tab portion 604 can be inserted into a corresponding electrical wire holder hole 136 in the loading tube 110. The tab portion 604 can lock the wire holder into place once an end of the tab portion 604 is pushed through the hole 136. Once locked into place, the tab portion 604 can abut or terminate proximate an inner wall of the carrier 102. The wiring of the power cable 502 can be completed at an off-site location, prior to arrival at the well site. Accordingly, users in the field can avoid wiring of the loading tube 110 as the loading tube 110 can arrive on-site "pre-wired".

Any number of wellbore perforating devices 100 can be lowered downhole via a wireline or other system. For example, 2, 3, 4, 5, 7, 9, or more wellbore perforating devices can be arranged in series and lowered in a single wellbore on a single pass. For example, the first bulkhead 114 of a first or lower wellbore perforating device (not shown) can be mate with or connect to a second bulkhead 116 of an adjacent second or upper wellbore perforating device (not shown). The power cables 502 of each wellbore perforating device in series can be connected to form a string of power cables.

In operation, the wellbore perforating device 100 can be assembled off-site by connecting or integrating the power cables 502 and/or wiring within the loading tube 110. The power cables 502 and/or wiring can be disposed through the wire holders 602 as depicted in FIG. 6. The wire holders 602, containing the power cables 502 and/or wiring, can be fed through an interior of the loading tube 110 and then pushed or otherwise inserted into corresponding wire holder holes 136 to provide pre-wired loading tubes 110. These pre-wired loading tubes 110 can then be delivered on-site, where a user in the field can the insert one or more initiators 112 into the loading tube 110. The initiator 112 can be inserted into the interior of the loading tube via an exposed end thereof or via the cutaway section 138. The retaining tabs 412 of the initiator 112 can then mate with corresponding holes or recesses in the loading tube 110, ensuring proper insertion of the initiator 112 in the loading tube 110. Once the initiator 112 has been inserted into the loading tube 110, the IDCs 410 can be pushed into the circuit board (not shown) of the initiator assembly 112 to connect the pre-wired power cable 502 to the initiator assembly 112. The user can then push the IDCs 410 into the detonator 402 and into the circuit board to connect the circuit board to the detonator 402. The user can then optionally insert the loading tube 110 into the carrier 102. The loading tube 110 can then be connected to a wireline system (not shown) and lowered downhole into a wellbore (not shown). Once the loading tube 110 has be lowered to a desired perforation depth downhole, the user can select a command to release the ballistic interrupt shutter 406, dislodging the shutter from between the detonator 402 and the detonator cord 404. The user can next select a command resulting in a signal or charge that can be transferred from the detonator 402 to the detonator cord 404, resulting in detonation of the perforating charges 202 and thus perforation of at least a portion of a formation downhole. The method can also include having a user selecting a single command resulting in the ballistic interrupt shutter 406 releasing, dislodging the shutter from between the detonator 402 and the detonator cord 404, followed by the detonator 402 firing and initiating the whole perforating string after a pre-determined delay.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A wellbore perforating device, comprising:

at least one perforating charge;

an initiator comprising a ballistic train adapted to fire the at least one perforating charge, the ballistic train comprising a detonator and a detonator cord; and a ballistic interrupt shutter disposed between the detonator and the detonator cord, wherein the ballistic interrupt shutter prevents firing of the detonator cord, wherein said ballistic interrupt shutter comprises a metallic layer disposed adjacent a layer of thermoplastic material.

2. The device of claim 1, wherein the ballistic interrupt shutter is removable from between the detonator and detonator cord when a command is entered from the surface.

3. The device of claim 2, wherein removal of the ballistic interrupt shutter couples the detonator with the detonator cord.

4. The device of claim 3, wherein the ballistic interrupt shutter is coupled to a spring and the spring is actuated by burning a fuse that causes the spring to dislodge the shutter from between the detonator and the detonator cord.

5. The device of claim 1, wherein the ballistic interrupt shutter prevents inadvertent firing of the at least one perforating charge, and wherein and removal of the ballistic interrupt shutter arms the ballistic train to fire the at least one perforating charge.

6. The device of claim 1, wherein the initiator comprises a circuit board adapted to communicate with the detonator via one or more insulation-displacement connectors.

7. The device of claim 1, wherein the initiator is disposed within a loading tube comprising a cutaway section that is disposed adjacent the initiator, and wherein the cutaway section provides a user access to the initiator.

8. The device of claim 7, wherein the initiator comprises one or more retaining tabs that are adapted to mate with corresponding holes located in the loading tube.

9. A perforating gun, comprising:

a loading tube having an initiator disposed therein, the initiator comprising a detonator and a detonator cord;

at least one perforating charge disposed within the loading tube; and a ballistic interrupt shutter disposed between the detonator and the detonator cord, wherein the ballistic interrupt shutter comprises a metallic layer disposed adjacent a layer of thermoplastic material.

10. The perforating gun of claim 9, wherein the ballistic interrupt shutter is removable from between the detonator and the detonator cord when a command is entered from the surface, thereby coupling the detonator with the detonator cord.

11. The perforating gun of claim 10, wherein the ballistic interrupt shutter is coupled to a spring, and the spring is actuated by burning a fuse that causes the spring to dislodge the shutter from between the detonator and the detonator cord.

12. The perforating gun of claim 9, wherein the initiator comprises a circuit board adapted to communicate with the detonator via one or more insulation-displacement connectors.

13. The perforating gun of claim 9, further comprising a coaxial cable contained within the loading tube, wherein the coaxial cable is adapted to communicate with a circuit board of the initiator via one or more insulation-displacement connectors.

14. The perforating gun of claim 13, wherein the coaxial cable is connected to one or more wire holders adapted to mate with one or more wire holder holes located on a surface of the loading tube.

15. A method of using a wellbore perforating device, comprising:

inserting an initiator into a loading tube of the wellbore perforating device, the initiator comprising:

a detonator and a detonator cord; and a ballistic interrupt shutter disposed between the detonator and the detonator cord, wherein the ballistic interrupt shutter comprises a metallic layer disposed adjacent a layer of thermoplastic material;

lowering the wellbore perforating device into a wellbore;

executing a first command releasing the ballistic interrupt shutter from between the detonator and the detonator cord; and executing a second command firing the wellbore perforating device.

16. The method of claim 15, further comprising connecting a coaxial cable to a circuit board of the initiator by pushing in one or more insulation-displacement connectors into the circuit board prior to lowering the wellbore perforating device, wherein the coaxial cable is disposed within the loading tube prior to inserting the initiator into the loading tube.

17. The method of claim 15, further comprising connecting the detonator to a circuit board of the initiator by pushing in one or more insulation-displacement connectors into the circuit board prior to lowering the wellbore perforating device.

18. The method of claim 15, wherein the execution of the first command sends a signal from a surface location to the wellbore perforating device downhole.

19. The method of claim 18, wherein the signal actuates a spring, causing the spring to dislodge the shutter from between the detonator and the detonator cord.

* * * * *